US005178342A

United States Patent [19]

Romagnoli

[11] Patent Number: 5,178,342

[45] Date of Patent: Jan. 12, 1993

[54] DYEING CONE

[75] Inventor: Tiziano Romagnoli, Prato, Italy

[73] Assignee: Mariplast S.p.A., Prato, Italy

[21] Appl. No.: 903,994

[22] Filed: Jun. 24, 1992

[30] Foreign Application Priority Data

Jun. 25, 1991 [IT] Italy ..... FI/91/U 72

[51] Int. Cl.[5] ..... B65H 75/20

[52] U.S. Cl. ..... 242/118.1; 242/118.3; 242/118.31

[58] Field of Search ..... 242/118.1, 118.11, 118.2, 242/118.3, 118.31, 118.32; 68/189, 198

[56] References Cited

U.S. PATENT DOCUMENTS

| | | | |
|---|---|---|---|
| 2,489,465 | 11/1949 | Russell | 242/118.1 X |
| 3,015,945 | 1/1962 | Jungbecker | 242/118.1 X |
| 3,532,291 | 10/1970 | Newman | 242/118.31 |
| 4,074,875 | 2/1978 | Fratturo | 242/118.3 |
| 4,519,557 | 5/1985 | Newman | 242/118.31 |
| 4,793,568 | 12/1988 | Romagnoli | 242/118.1 |

FOREIGN PATENT DOCUMENTS

| | | | |
|---|---|---|---|
| 2755915 | 5/1979 | Fed. Rep. of Germany | 242/118.1 |
| 1094379 | 12/1954 | France | 242/118.1 |
| 1354344 | 1/1964 | France | 242/118.1 |
| 1492546 | 7/1967 | France | 242/118.1 |
| 207153 | 4/1285 | Italy . | |
| 968983 | 9/1964 | United Kingdom | 242/118.1 |
| 979791 | 1/1965 | United Kingdom | 242/118.1 |

*Primary Examiner*—Stanley N. Gilreath
*Attorney, Agent, or Firm*—McGlew and Tuttle

[57] ABSTRACT

A dyeing cone (1) comprising a shell with apertures for the passage of the dyeing liquid, this shell defining an external surface (5) for the winding of the turns of yarn and an internal surface (7) for guiding along a bar of the dyeing machine; the internal surface consists of a first cylindrical portion (21) and of a second conical portion (23) whose smaller diameter is greater than the diameter of the cylindrical portion; ribs (31) projecting toward the axis of the cone extend on the conical portion (21), and constitute an extension of the cylindrical portion and in their lower part form a stop (31A) for a cone located below.

9 Claims, 2 Drawing Sheets

IV
V
21
11
1
R
II
V
9
II
15
15
7
3
IV
5
9
23
31
31A
35
III
R
29
27
25
13
13
III

DYEING CONE

The invention relates to a dyeing cone of the type comprising a shell with apertures for the passage of the dyeing liquid, this shell defining an external surface on which the turns of yarn are wound and an internal surface for guiding the dyeing cone along a bar of the dyeing machine.

A dyeing cone of this type is described, for example, in IT—Italian industrial utility model No. 207,153 in the name of the present holder. According to this model, the shell of the cone forms an external surface which has a cylindrical end portion, a conical intermediate portion, and an upper terminal portion which is also cylindrical but of smaller diameter than the cylindrical end portion. The shape of this dyeing cone is designed in such a way as to guide said cone on the bar of the dyeing machine by means of the internal cylindrical surface formed by the shell of said cone. The lower portion of the cone (in other words the cylindrical part with the greater diameter) permits the partial penetration of superimposed cones during the dyeing phase. This dyeing cone has the disadvantage of having a non-constant inclination of the external surface. This makes it difficult or even impossible to use on certain spinning machines, such as continuous spinning machines of the open-end type or similar.

The subject of the invention is a dyeing cone of the type mentioned above, which permits the formation of reels for dyeing on open-end spinning machines, and which may be stacked together with cones located above or below to form rows of reels partially penetrating into each other to obtain a compaction of the turns and an optimized dyeing operation.

In substance, in the dyeing cone according to the invention the internal surface of the cone consists of a first cylindrical portion which extends from the smaller end of the cone toward the larger end over a fraction of the axial extension of the cone, and of a second conical surface portion whose smaller diameter is greater than the diameter of the cylindrical portion; ribs projecting toward the axis of the cone extend on said conical portion, which ribs constitute an extension of the cylindrical portion and in their lower part form a stop for a cone which is located below and partially penetrates into the next cone; and the external surface of the shell for winding the turns is conical substantially over the whole axial extension of said cone.

The dyeing cone according to the invention therefore has an external surface with a substantially constant inclination, suitable for use on any type of spinning machine and particularly on spinning machines of the open-end type. Moreover, the structure of the internal surface permits both the correct guiding of the dyeing cone along the bar of the dyeing machine, the reciprocal centering of superimposed cones by penetration, and the partial penetration of a number of cones for dyeing in the reel.

According to a particular embodiment of the cone according to the invention, the ribs provided on the conical portion of the internal surface of the shell advantageously terminate in sections having a smaller radial projection, which extend into the lower area, in other words near to the larger end of the cone; the stop for the cone located below is formed in the area of transition between the rib and the terminal section of smaller projection, while the section of smaller projection extends toward the area of penetration by said cone located below. This terminal section of each rib may advantageously have a flared and centering profile to facilitate the insertion of the tapered portion, in other words the upper portion, of a cone located below which partially penetrates into the cone above when the cones are placed on the bar for dyeing.

On the internal surface, near the larger end, there may be an annular groove having a greater diameter than the maximum diameter of the conical portion of the internal surface of the shell, which has the purpose of facilitating the insertion of the tapered portion of the cone located below and of preventing the trapping of the yarn.

Further advantageous characteristics of the dyeing cone according to the invention are illustrated in the following description and in the attached claims.

The drawing shows a possible embodiment of the invention, and, in particular,

Figure 1:
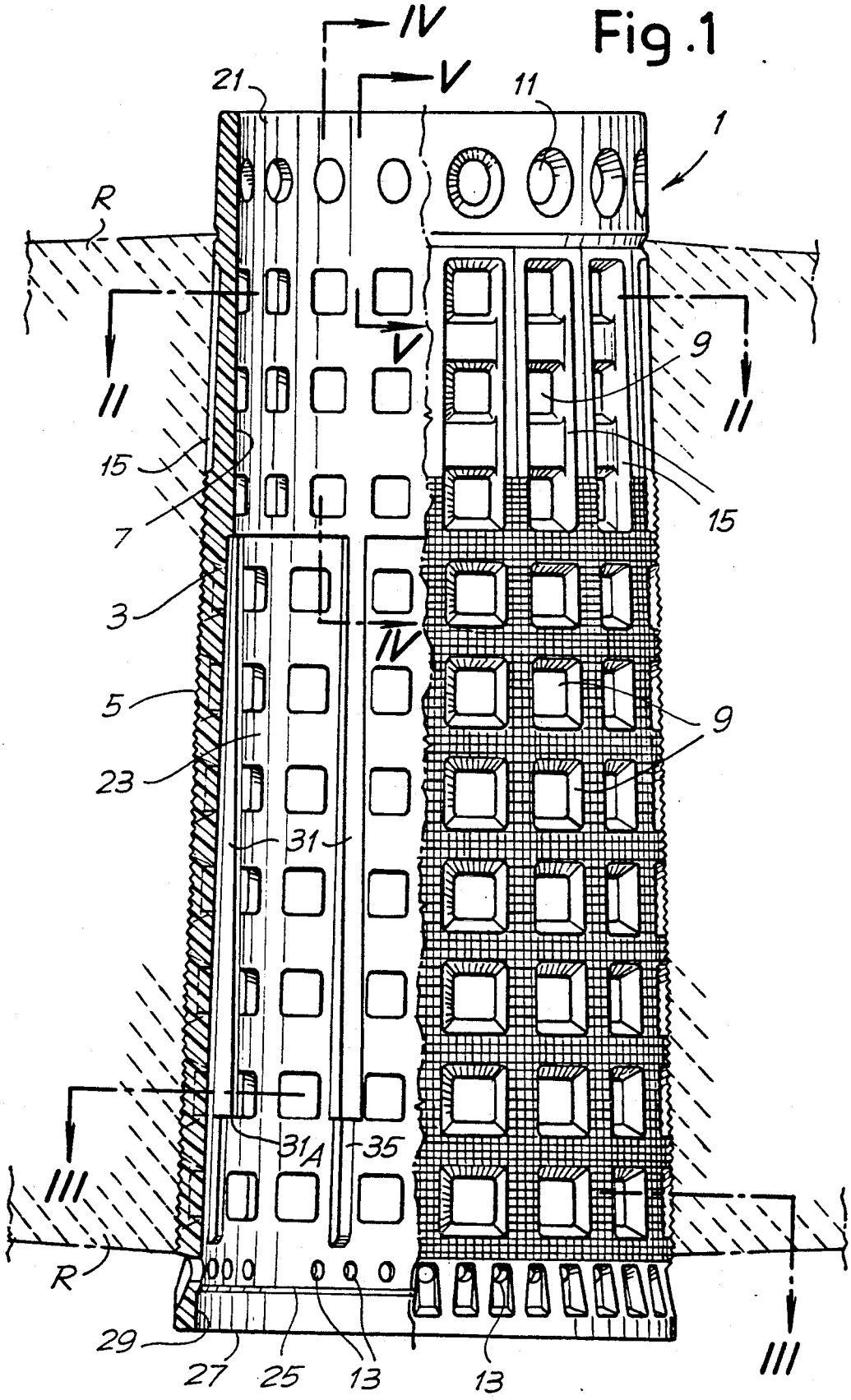
FIG. 1 shows a side view and partial longitudinal section of a cone according to the model.
Figure 2:
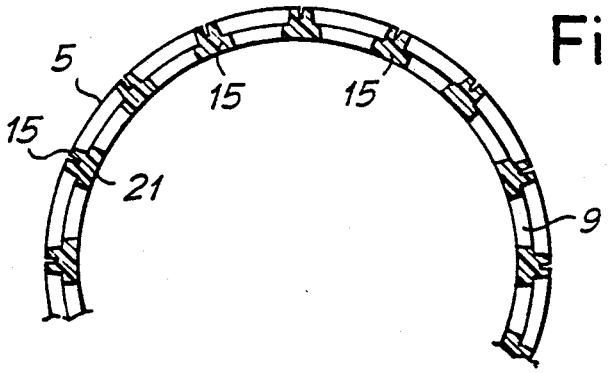
FIG. 2 shows a partial transverse section through II—II in FIG. 1.
Figure 3:
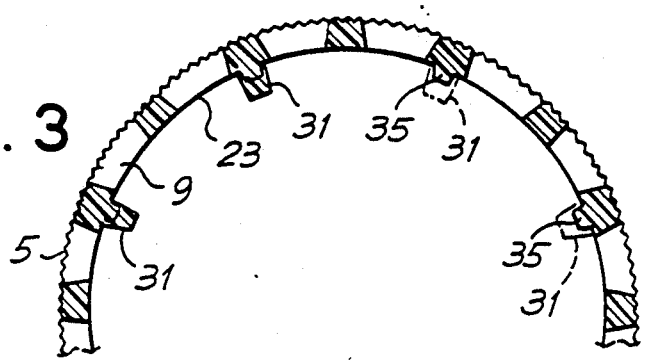
FIG. 3 shows a further partial transverse section through III—III in FIG. 1.

The dyeing cone according to the model is indicated as a whole by 1 and consists of a shell 3 with an external surface indicated as a whole by 5 and an internal surface indicated as a whole by 7. A reel of yarn R for dyeing is wound on the external surface 5. Said external surface 5 has a conical extension with a substantially constant inclination over a longitudinal extension substantially corresponding to the area of winding of the turns of yarn forming the reel.

The shell 3 is permeable and has a plurality of substantially square apertures indicated by 9 over the whole of the conical shell except for the areas near the lower and upper ends. Substantially circular apertures 11 are provided in the upper area of the shell 3, while small apertures 13 in the form of holes are provided in the lower portion near the larger end of the cone.

The external surface 5 of the shell 3 is divided substantially into two areas: the lower area consists of a grid structure defining the apertures 9, characterized by a surface relief which has the object of preventing the slipping and sliding of the turns of yarn wound on the cone. The upper area of the surface 5 of the shell 3 has a plurality of rib structures 15 extending substantially parallel to the generatrices of the conical surface 5. These rib structures 15 have a substantially smooth upper surface to permit the sliding of the turns of yarn when successive reels are placed above with partial penetration of one cone into the next for the dyeing operations.

The internal surface 7 of the shell 3 has a first substantially cylindrical portion 21 which extends downward from the edge of the tapered end of the cone approximately ⅓ of the axial extension of the cone. This cylindrical portion is used to guide the dyeing cone along the bar of the dyeing machine.

Below the cylindrical portion 21, the internal surface 7 of the shell 3 has a conical lower portion 23 which extends substantially as far as an annular shoulder 25 which extends near the lower edge 27 of the dyeing cone. A substantially cylindrical annular cavity 29, whose diameter is slightly greater than the maximum diameter of the conical portion 23 of the internal surface 7 of the dyeing cone, extends between the edge 27 and the shoulder 25.

Figure 4:
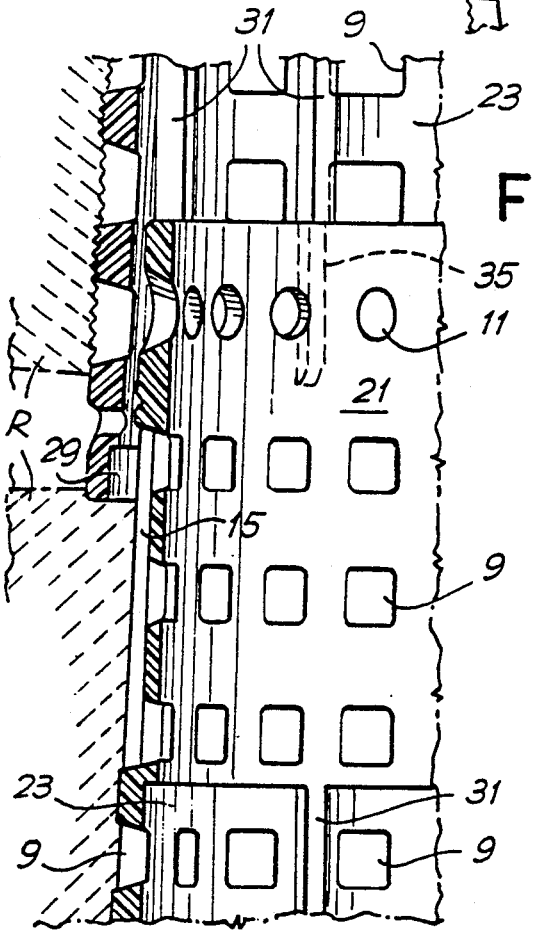
FIGS. 4 and 5 show two partial longitudinal sections through IV—IV and V—V respectively in FIG. 1.
Figure 5:
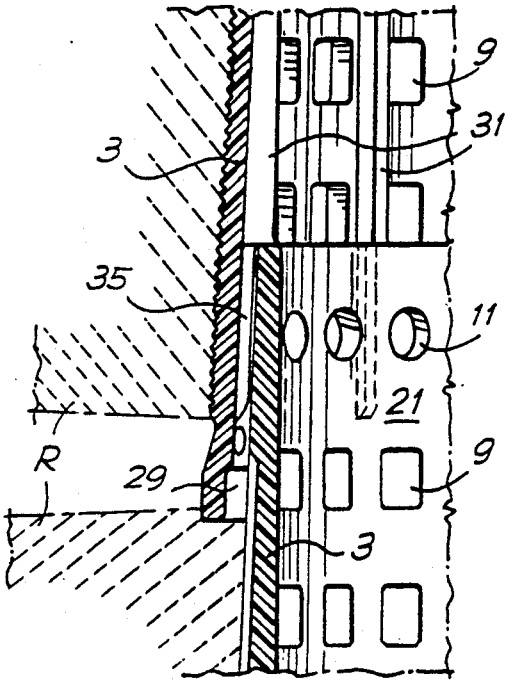

As may be clearly seen in the upper part of FIG. 1 and in the lower part of FIG. 4, the minimum diameter of the conical portion 23 of the internal surface 7 is slightly greater than the diameter of the cylindrical portion 21. Radial ribs 31 extend along the conical portion 23, and their surfaces radially facing the axis of the cone lie on a theoretical cylindrical surface which constitutes the extension of the cylindrical portion 21 of the internal surface 7. Each rib 31 forms a step 31A in its lower part, and all the steps of the various ribs 31 of the cone constitute a stop for the upper edge of a cone located below which can penetrate partially into the axial cavity of a cone located above when a plurality of dyeing cones are superimposed and aligned along a bar of a dyeing machine. The configuration of partially penetrating cones is clearly shown in sections 4 and 5. Each rib 31 has, in addition to the step 31A, an extension consisting of a corresponding terminal section 35 having a transverse section smaller than that of the corresponding rib 31. The sections 35 form a flared centering profile for the tapered end of the cone located below during the partial penetration, as is clearly seen in FIG. 5. The centering and penetration of superimposed cones is further facilitated by the annular cavity 29 disposed at the lower edge 27 of the cone.

When a number of cones 1 are superimposed along a bar of a dyeing machine, the tapered portion of each cone (with the exception of the top cone) penetrates partially into the axial cavity of the cone located above, until it is stopped by the steps 31A of the ribs 31. This causes a sliding of the turns forming the reel under the action of the edge 27 of the cone located above, this sliding being facilitated by the smooth surface of the rib structures 15. Any turns of yarn which remain between the lower portion of one cone and the upper portion of the cone located below will be bathed with dye through the apertures 13 provided for this purpose at the edge 27 of the cone.

I claim:

1. A dyeing cone comprising a shell with apertures for the passage of dyeing liquid, this shell defining an external surface for the winding of turns of yarn and an internal surface for guiding along a bar of a dyeing machine, wherein said internal surface consists of a first cylindrical portion, extending from the smaller end of the cone toward the larger end over a part of the axial extension of the cone, and of a second conical portion whose smaller diameter is greater than the diameter of the cylindrical portion; ribs projecting toward the axis of the cone extend on said conical portion, and constitute an extension of the cylindrical portion and in their lower part form a stop for a cone which is located below; and the external surface of the shell is conical substantially over the whole extension of the yarn winding surface.

2. The dyeing cone as claimed in claim 1, wherein said ribs terminate in sections having a smaller projection extending between the stop and the lower area of the dyeing cone.

3. The dyeing cone as claimed in claim 2, wherein the terminal sections of said ribs form a flared and centering profile for the upper tapered part of a cone located below.

4. The dyeing cone as claimed in claim 1, wherein the conical portion of the internal surface terminates a short distance from the larger end of the dyeing cone, and wherein an annular seat having a greater diameter than that of the conical portion is provided between said conical portion and said larger end.

5. The dyeing cone as claimed in claim 1, wherein a series of holes of smaller size than the apertures in the remaining portion of the shell forming the cone is provided near the larger end.

6. The dyeing cone as claimed in claim 1, wherein the external conical surface of the shell has a lower area with surface reliefs capable of preventing the sliding of the turns of yarn, and a smooth upper area.

7. The dyeing cone as claimed in claim 6, wherein said lower and upper areas of the external surface correspond approximately to the lower conical portion and to the upper cylindrical portion, respectively, of the internal surface.

8. The dyeing cone as claimed in claim 6, wherein the lower area of the external surface has an axial extension slightly greater than that of the corresponding lower conical portion of the lower surface.

9. The dyeing cone as claimed in claim 6, wherein the upper area of the external surface has ribs extending parallel to the generatrices of the conical surface.

* * * * *